US008542789B2

(12) United States Patent
Russell, II et al.

(10) Patent No.: US 8,542,789 B2
(45) Date of Patent: Sep. 24, 2013

(54) IRRADIATION TARGET POSITIONING DEVICES AND METHODS OF USING THE SAME

(75) Inventors: William Earl Russell, II, Wilmington, NC (US); Heather J. Hatton, Wilmington, NC (US); Melissa Allen, Wilmington, NC (US); Melissa L. Hladik, Leland, NC (US); Samuel John Lafountain, Williamsburg, VA (US); Luis Alberto Torres, East Palo Alto, CA (US); Erick W. Dittmer, Hampstead, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 591 days.

(21) Appl. No.: 12/718,260

(22) Filed: Mar. 5, 2010

(65) Prior Publication Data

US 2011/0216868 A1 Sep. 8, 2011

(51) Int. Cl.
*G21G 1/06* (2006.01)

(52) U.S. Cl.
USPC ..... 376/189; 376/158; 376/202; 376/426

(58) Field of Classification Search
USPC ..... 376/153, 154, 158, 156, 159, 193, 376/202
See application file for complete search history.

(56) References Cited

U.S. PATENT DOCUMENTS

| | | | |
|---|---|---|---|
| 3,594,275 | A | 7/1971 | Ransohoff et al. |
| 3,940,318 | A | 2/1976 | Arino et al. |
| 3,998,691 | A | 12/1976 | Shikata et al. |
| 4,196,047 | A | 4/1980 | Mitchem et al. |
| 4,284,472 | A | 8/1981 | Pomares et al. |
| 4,462,956 | A | 7/1984 | Boiron et al. |
| 4,475,948 | A | 10/1984 | Cawley et al. |
| 4,493,813 | A | 1/1985 | Loriot et al. |
| 4,532,102 | A | 7/1985 | Cawley |
| 4,597,936 | A | 7/1986 | Kaae |
| 4,617,985 | A | 10/1986 | Triggs et al. |
| 4,663,111 | A | 5/1987 | Kim et al. |
| 4,729,903 | A | 3/1988 | McGovern et al. |
| 4,782,231 | A | 11/1988 | Svoboda et al. |
| 4,859,431 | A | 8/1989 | Ehrhardt |

(Continued)

FOREIGN PATENT DOCUMENTS

| | | | |
|---|---|---|---|
| JP | 2007-170890 A | | 7/2007 |
| JP | 2007170890 A | * | 7/2007 |

OTHER PUBLICATIONS

Swedish Office Action issued in connection with SE Patent Application No. 1150132-7, Dec. 21, 2011.

*Primary Examiner* — Timothy A Brainard
(74) *Attorney, Agent, or Firm* — Harness, Dickey & Pierce, P.L.C.

(57) ABSTRACT

Example embodiments and methods are directed to irradiation target positioning devices and systems that are configurable to permit accurate irradiation of irradiation targets and accurate production of daughter products, including isotopes and radioisotopes, therefrom. These include irradiation target plates having precise loading positions for irradiation targets, where the targets may be maintained in a radiation field. These further include a target plate holder for retaining and positioning the target plates and irradiation targets therein in the radiation field. Example embodiments include materials with known absorption cross-sections for the radiation field to further permit precise, desired levels of exposure in the irradiation targets. Example methods configure irradiation target retention systems to provide for desired amounts of irradiation and daughter product production.

14 Claims, 6 Drawing Sheets

(56) References Cited

U.S. PATENT DOCUMENTS

| | | | | |
|---|---|---|---|---|
| 5,053,186 | A | 10/1991 | Vanderheyden et al. | |
| 5,145,636 | A | 9/1992 | Vanderhevden et al. | |
| 5,355,394 | A | 10/1994 | Van Geel et al. | |
| 5,400,375 | A | 3/1995 | Suzuki et al. | |
| 5,513,226 | A | 4/1996 | Baxter et al. | |
| 5,596,611 | A | 1/1997 | Ball | |
| 5,615,238 | A | 3/1997 | Wiencek et al. | |
| 5,633,900 | A | 5/1997 | Hassal | |
| 5,682,409 | A | 10/1997 | Caine | |
| 5,758,254 | A | 5/1998 | Kawamura et al. | |
| 5,867,546 | A | 2/1999 | Hassal | |
| 5,871,708 | A | 2/1999 | Park et al. | |
| 5,910,971 | A | 6/1999 | Ponomarev-Stepnoy et al. | |
| 6,056,929 | A | 5/2000 | Hassal | |
| 6,160,862 | A | 12/2000 | Wiencek et al. | |
| 6,192,095 | B1 | 2/2001 | Sekine et al. | |
| 6,233,299 | B1 | 5/2001 | Wakabayashi | |
| 6,456,680 | B1 | 9/2002 | Abalin et al. | |
| 6,678,344 | B2 | 1/2004 | O'Leary et al. | |
| 6,751,280 | B2 | 6/2004 | Mirzadeh et al. | |
| 6,804,319 | B1 | 10/2004 | Mirzadeh et al. | |
| 6,895,064 | B2 | 5/2005 | Ritter | |
| 6,896,716 | B1 | 5/2005 | Jones, Jr. | |
| 7,157,061 | B2 | 1/2007 | Meikrantz et al. | |
| 7,235,216 | B2 | 6/2007 | Kiselev et al. | |
| 8,229,054 | B2 * | 7/2012 | Guillen et al. | 376/340 |
| 2002/0034275 | A1 | 3/2002 | Abalin et al. | |
| 2003/0012325 | A1 | 1/2003 | Kernert et al. | |
| 2003/0016775 | A1 | 1/2003 | Jamriska, Sr. et al. | |
| 2003/0103896 | A1 | 6/2003 | Smith | |
| 2003/0179844 | A1 | 9/2003 | Filippone | |
| 2004/0091421 | A1 | 5/2004 | Aston et al. | |
| 2004/0105520 | A1 | 6/2004 | Carter | |
| 2004/0196942 | A1 | 10/2004 | Mirzadeh et al. | |
| 2004/0196943 | A1 | 10/2004 | Di Caprio | |
| 2005/0105666 | A1 | 5/2005 | Mirzadeh et al. | |
| 2005/0118098 | A1 | 6/2005 | Vincent et al. | |
| 2006/0062342 | A1 | 3/2006 | Gonzalez Lepera et al. | |
| 2006/0126774 | A1 | 6/2006 | Kim et al. | |
| 2007/0133731 | A1 | 6/2007 | Fawcett et al. | |
| 2007/0133734 | A1 * | 6/2007 | Fawcett et al. | 376/438 |
| 2007/0297554 | A1 | 12/2007 | Lavie et al. | |
| 2008/0031811 | A1 | 2/2008 | Ryu et al. | |
| 2008/0076957 | A1 | 3/2008 | Adelman | |
| 2009/0274260 | A1 | 11/2009 | Russell, II et al. | |

* cited by examiner

IRRADIATION TARGET POSITIONING DEVICES AND METHODS OF USING THE SAME

BACKGROUND

1. Field

Example embodiments generally relate to fuel structures and radioisotopes produced therein in nuclear power plants and other nuclear reactors.

2. Description of Related Art

Radioisotopes have a variety of medical applications stemming from their ability to emit discreet amounts and types of ionizing radiation. This ability makes radioisotopes useful in cancer-related therapy, medical imaging and labeling technology, cancer and other disease diagnosis, medical sterilization, and a variety of other industrial applications.

Radioisotopes, having specific activities are of particular importance in cancer and other medical therapy for their ability to produce a unique and predictable radiation profile. Knowledge of the exact amount of radiation that will be produced by a given radioisotope permits more precise and effective use thereof, such as more timely and effective medial treatments and improved imaging based on the emitted radiation spectrum.

Radioisotopes are conventionally produced by bombarding stable parent isotopes in accelerators or low-power reactors with neutrons on-site at medical facilities or at nearby production facilities. The produced radioisotopes may be assayed with radiological equipment and separated by relative activity into groups having approximately equal activity in conventional methods.

SUMMARY

Example embodiments and methods are directed to irradiation target positioning devices and systems that are configurable to permit accurate irradiation of irradiation targets and accurate production of daughter products, including isotopes and radioisotopes, therefrom. Example embodiments include irradiation target plates having precise loading positions for irradiation targets, where the targets may be maintained in a radiation field, such as a neutron flux. Example embodiment target plates may further include holes and target spacing elements to further refine the positioning of irradiation targets of very small or large size within the field. Example embodiments may further include a target plate holder for retaining and positioning the target plates and irradiation targets therein in the radiation field. Example embodiment target plate holders may further include spacer plates to further refine the positioning of irradiation target plates within example embodiment target plate holders. Example embodiments may be fabricated of materials with known absorption cross-sections for the radiation field to further permit precise, desired levels of exposure in the irradiation targets.

Example methods configure irradiation target retention systems to provide for desired amounts of irradiation and daughter product production. Example methods may include determining a desired daughter product, determining characteristics of an available radiation field, configuring the irradiation targets within example embodiment target plates and target plate holders, and/or irradiating the configured system in the radiation field.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Detailed illustrative embodiments of example embodiments are disclosed herein. However, specific structural and functional details disclosed herein are merely representative for purposes of describing example embodiments. The example embodiments may, however, be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 1:
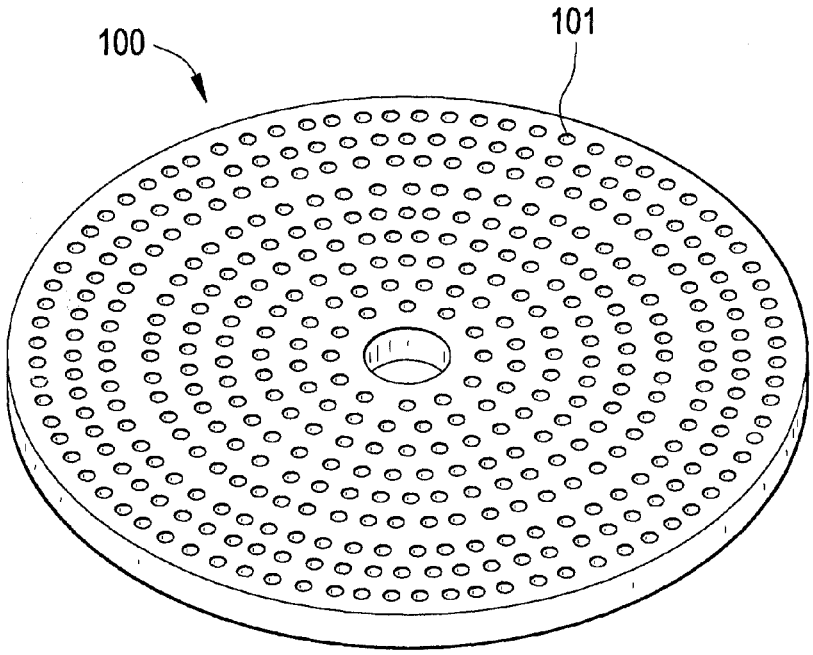
FIG. 1 is an illustration of an example embodiment target plate.

FIG. 1 is an illustration of an example embodiment target plate 100. As shown in FIG. 1, example embodiment target plate 100 may be a circular disk, or, alternatively, any shape, including square, elliptical, toroidial, etc., depending on the application. Target plate 100 includes one or more loading positions 101 where irradiation targets may be placed and retained. Loading positions 101 are positioned in target plate 100 at positions of known radiation levels when target plate 100 is subject to a neutron flux or other radiation field. As used herein "radiation level" or "radiation field" includes any type of ionizing radiation exposure capable of transmuting targets placed in the radiation field, including, for example, high-energy ions from a particle accelerator or a flux of neutrons of various energies in a commercial nuclear reactor. For example, if target plate 100 is placed in neutron flux at a particular position in an operating commercial nuclear reactor, exact levels and types of neutron flux at loading positions 101 are known, such that each position may correspond to a particular level of exposure given an exposure time.

In this way, loading positions 101 may be arranged in example embodiment target plate 100 so as to ensure irradiation targets at those positions are exposed to an exact and desired level of radiation exposure. As an example, it may be desirable to place loading positions 101 so that each position is exposed to an equal amount of neutron flux in a light-water reactor. Knowing the flux profile to which target plate 100 will be exposed and the relevant cross-sections, including absorption and scattering/reflection cross-sections, of target plate 100, loading positions 101 can be arranged such that each loading position 101 receives equal irradiation, including, for example, having loading positions 101 be more frequent at an outer perimeter of target plate 100 where more flux is encountered, as shown in FIG. 1.

Figure 2:
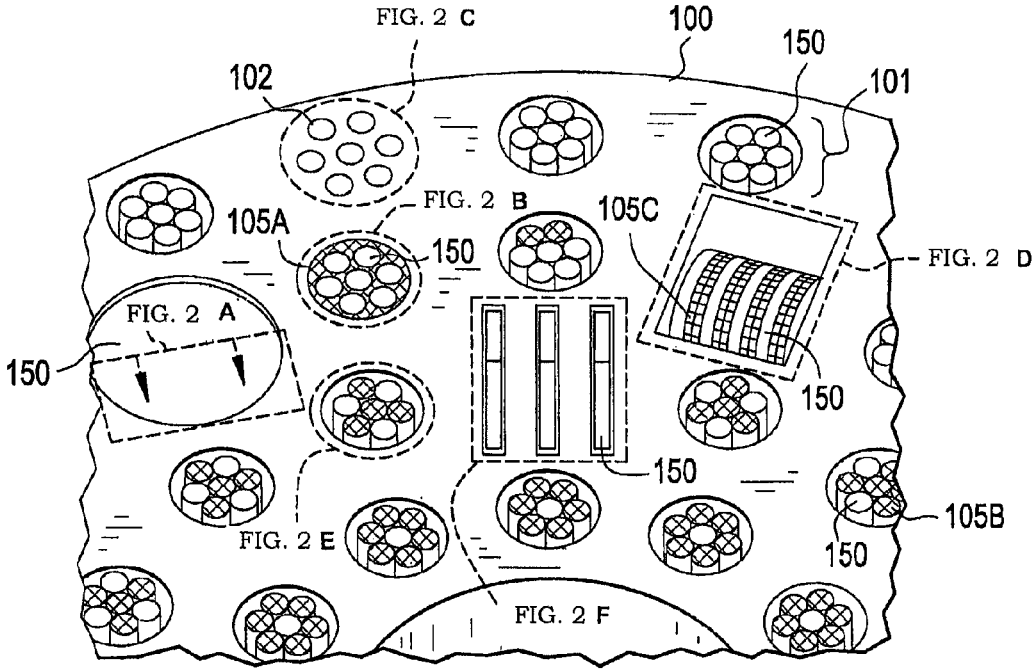
FIG. 2 is an illustration of an example embodiment target plate and details of irradiation targets and spacers therein.

FIG. 2 is another view of example embodiment target plate 100 showing various example arrangements at loading positions 101 and irradiation targets 150 therein, wherein detailed views are provided in FIGS. 2A-2F. One or more holes 102 that extend partially or completely through target plate 100 may be at a loading position 101 to hold one or more irradiation target 150. Holes 102 may be any shape.

Figure 2A:
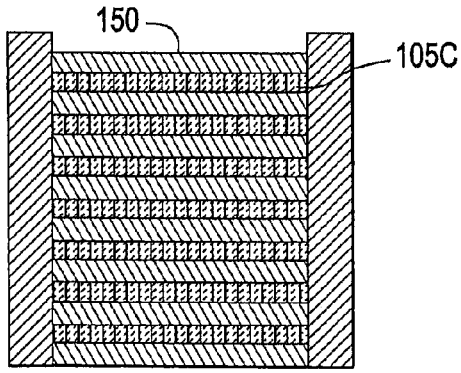
FIG. 2A is a detail of a loading position in the example embodiment target plate of FIG. 2.
Figure 2B:
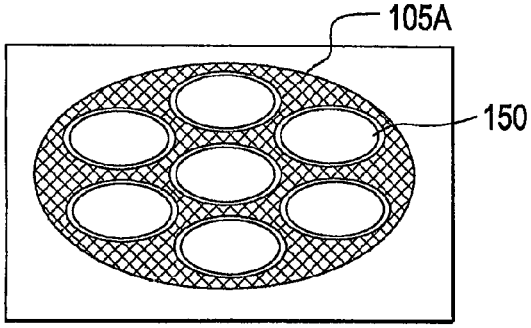
FIG. 2B is a detail of a loading position in the example embodiment target plate of FIG. 2.
Figure 2C:
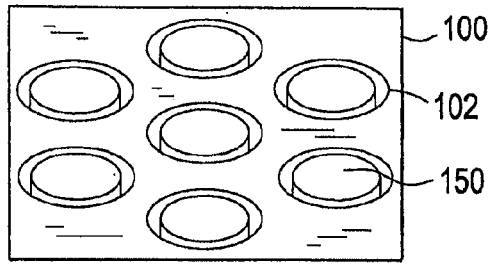
FIG. 2C is a detail of a loading position in the example embodiment target plate of FIG. 2.
Figure 2D:
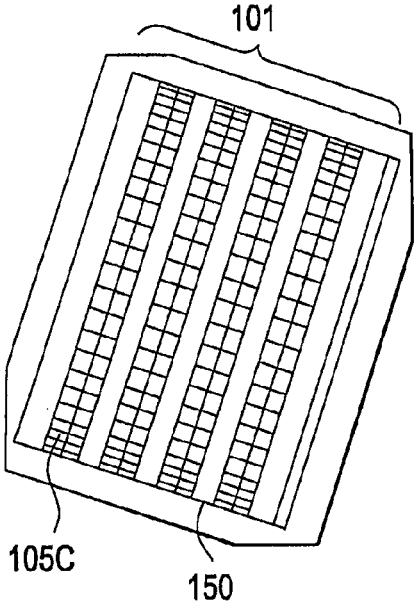
FIG. 2D is a detail of a loading position in the example embodiment target plate of FIG. 2.

For example, as shown in the details of FIG. 2A and 2C, holes 102 may be shaped to match a shape of irradiation targets 150 therein, including, for example, cylindrical holes 102 to hold cylindrical irradiation targets 150. As a further example, as shown in the details of FIG. 2D and 2F, holes 102 may be shaped as slits to hold disk or flat irradiation targets 150. A number of irradiation targets 150 may be loaded into any hole 102 based on the estimated neutron flux profile at a loading position 101 of the hole. For example, loading positions 101 expected to be exposed to higher levels of radiation may include holes 102 having more irradiation targets 150 loaded therein. While example embodiments illustrate holes 102 at loading positions 101, it is understood that other irradiation target retention mechanisms, such as an adhesive or containment compartment, for example, are useable to retain irradiation targets 150 at loading positions 101.

A single hole 102 may be at a loading position 101, as shown in the details of FIG. 2A, for example, or multiple holes may be at a loading position 101, as shown in the details of FIG. 2C, for example. Example embodiment target plates 100 may include a variety of holes 102 of different shapes and numbers at different loading positions 101. For example, in order to accommodate different shapes of irradiation targets 150 and based on the known flux profile to which target plate 100 is exposed, multiple square holes 102 may be placed at edge loading positions 101 while a single, cylindrical hole 102 may be at interior loading positions 101.

Irradiation targets 150 may take on a number of shapes, sizes, and configurations and may be placed, sealed, and/or retained in holes 102 or other retaining mechanisms at loading positions 101 in a variety of ways. The size of the irradiation targets 150 may be adjusted as appropriate for their intended use (e.g., radiography targets, brachytherapy seeds, elution matrix, etc.). For instance, an irradiation target 150 may have a length of about 3 mm and a diameter of about 0.5 mm. Irradiation targets 150 may also be spherical-, disk-, wafer-, and/or BB-shaped, or any other size and shape, within different types of holes 102 in the same target plate 100, as shown in FIG. 2. It should be understood that the size of the holes 102 and/or the thickness of the example embodiment target plates 100 may be adjusted as needed to accommodate the targets 150.

Irradiation targets 150 are strategically loaded at the appropriate loading positions 101 based on various factors (including the characteristics of each target material, known flux conditions of a reactor core, the desired activity of the resulting targets, etc.) discussed in greater detail below, so as to attain daughter products from irradiation targets 150 having a desired concentration or activity level, such as a relatively uniform activity.

Irradiation targets 150 may be formed of the same material or different materials. Irradiation targets 150 may also be formed of natural isotopes or enriched isotopes. As used herein it is understood that irradiation targets 150 include those materials having a substantial absorption cross-section for the type of irradiation to which example embodiments may be exposed, such that irradiation targets 150 include materials that will absorb and transmute in the presence of a radiation field. For example, suitable targets 150 may be formed of cobalt (Co), chromium (Cr), copper (Cu), erbium (Er), germanium (Ge), gold (Au), holmium (Ho), iridium (Ir), lutetium (Lu), molybdenum (Mo), palladium (Pd), samarium (Sm), thulium (Tm), ytterbium (Yb), and/or yttrium (Y), although other suitable materials may also be used. Similarly, targets may be liquid, solid, or gaseous within appropriate containment at loading positions 101, such as in holes 102.

In order to preserve spacing among irradiation targets 150 and orientation of irradiation targets 150 within a known radiation field to which they are exposed, one or more spacing elements 105 may space and/or retain irradiation targets 150 within holes 102. For example, as shown in the details of FIG. 2B, a single target spacing element 105A may be placed in a hole 102 to retain and space irradiation targets 150 at proper positions at loading positions 101. Alternatively, as shown in the details of FIG. 2E, one or more target spacing elements 105B may be shaped like a dummy target and inserted into hole 102 to retain and space irradiation targets 150 at proper positions within a hole 102 at irradiation target loading position 101.

Figure 2E:
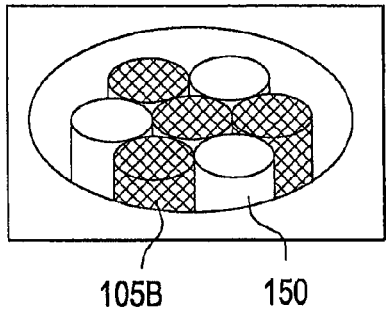
FIG. 2E is a detail of a loading position in the example embodiment target plate of FIG. 2.
Figure 2F:
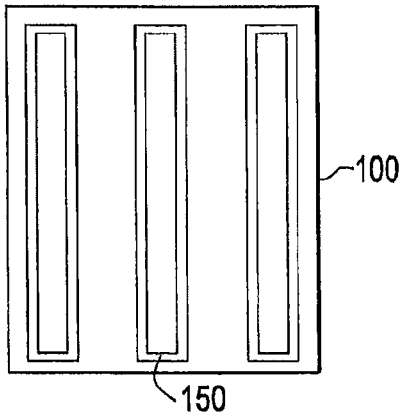
FIG. 2F is a detail of a loading position in the example embodiment target plate of FIG. 2.
Figure 3:
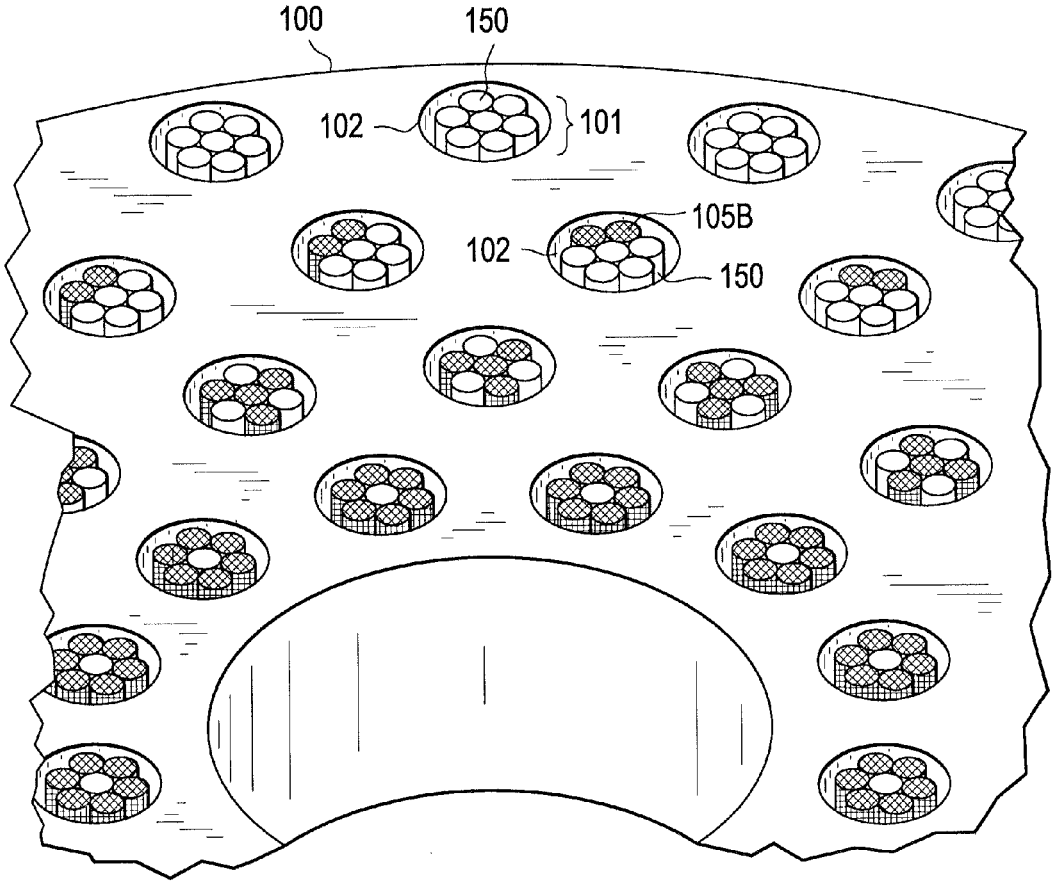
FIG. 3 is a detail illustration of an example embodiment target plate having irradiation targets and spacers arranged therein in accordance with example methods.

FIG. 3 is an illustration of an example embodiment target plate 100 using target spacing elements 105B, like those shown in the details of FIG. 2E, at each loading position 101 having a hole 102. As shown in FIG. 3, each hole 102 may be equally filled with a combination of target spacing elements 105B and/or irradiation targets 150. In accordance with example methods, discussed below, loading positions 101 at a periphery may contain an increased ratio of irradiation targets 150 to target spacing elements 105B, whereas loading positions 101 may have a lower ratio, in order to produce daughter products of a desired activity.

Still alternatively, as shown in FIG. 2D, target spacing elements 105C may be shaped like wafers having a thickness sufficient to separate irradiation targets 150 in a slit-type hole 102. The separation may space irradiation targets 150 at desired positions for irradiation. Other types of spacing and retaining elements, including caps, adhesives, elastic members, etc. may be useable as target spacing elements 105.

Example embodiment target plate 100 and any spacing elements 105 therein may be fabricated from materials having a desired cross-section, in view of the type of radiation field to which example embodiments may be exposed. For example, example embodiment target plate 100 being exposed to a thermal neutron flux field may be fabricated of a material having a low thermal neutron absorption and scattering cross-section, such as zirconium or aluminum, in order to maximize neutron exposure to irradiation targets 150 therein. For example, if example embodiment target plate 100 is exposed to an aggregate neutron flux with a wide energy distribution, spacing elements 105 may be fabricated of a material, such as paraffin, having a high absorption cross-section for particular energy neutrons to ensure that irradiation targets 150 are not exposed to a neutron flux of the particular energy.

The above-described features of example embodiment target plate 100 and the known radiation profile to which target plate 100 is to be exposed may uniquely enable accurate irradiation of irradiation targets 150 used therein. For example, knowing an irradiation flux type and profile; a shape, size, and absorption cross-section of irradiation targets 150; and size, shape, position, and absorption cross-section of example embodiment target plate 100, loading positions 101 on the same, and target spacing elements 105 therein, one may very accurately position and irradiate targets 150 to produce desired isotopes and/or radioisotopes. Similarly, one skilled in the art can vary any of these parameters, including irradiation target type, shape, size, position, absorption cross-section etc., in example embodiments in order to produce desired isotopes and/or radioisotopes.

FIG. 3 illustrates an example arrangement for target plate 100 where outer loading positions 101 will be directly exposed to higher levels of radiation when the target plate 100 is placed in a neutron flux, such as found in an operating nuclear reactor core. A greater number of irradiation targets 150 may be placed at each of the outer positions 101, thereby resulting in more equal activity amongst the irradiation targets 150 in the outer loading positions 101. Fewer irradiation targets 150 may be placed in each of the inner loading positions 101 to offset the fact that these irradiation targets 150 will be farther from the flux, thereby allowing irradiation targets 150 in the inner loading positions 101 to attain activity levels comparable to targets 150 in the outer loading positions 101. It is understood, however, in light of the above discussion, that the example arrangement of FIG. 3 may be altered in several ways so as to increase/decrease the resulting activity of each irradiation target 150 following irradiation. For instance, irradiation targets 150 formed of materials having lower capture cross-sections for a particular radiation field may be arranged at loading positions 101 that will be in closer proximity to the field, whereas irradiation targets 150 of materials with higher cross-sections may be positioned in example embodiment target plates 101 farther away from the field.

Figure 4:
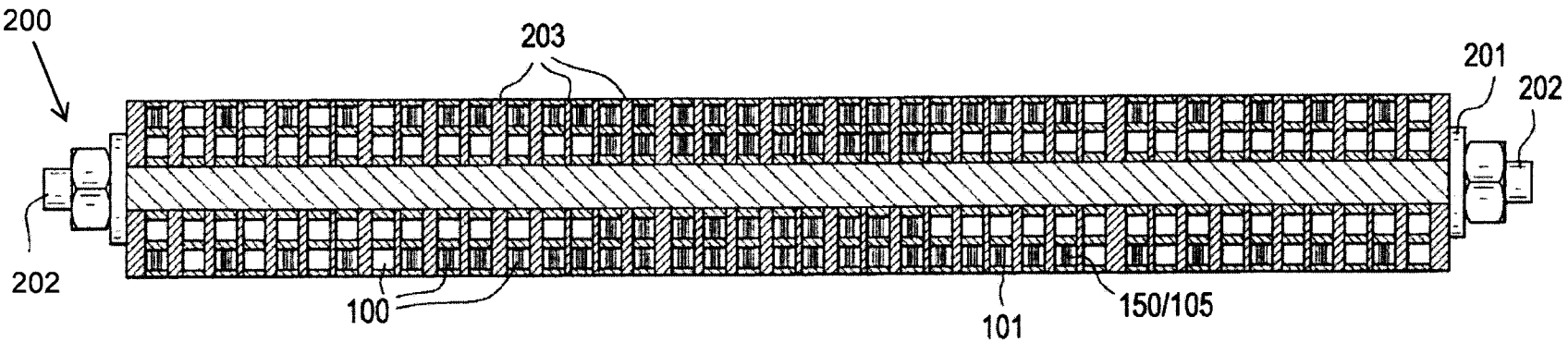
FIG. 4 is an illustration of an example embodiment target plate holder.

FIG. 4 is an illustration of an example embodiment target plate holder 200 that is useable with example embodiment target plates 100 described above. As shown in FIG. 4, example embodiment target plate holder 200 may include a body 201 that is insertable in a radiation field. Body 201 may be rigid or flexible. Body 201 may be shaped and/or sized to fit in areas where radiation fields may exist, including, for example, an instrumentation tube of a light-water reactor, a nuclear fuel rod, an access tube for a particle accelerator, etc. Similarly, multiple example embodiment target plates holders 200 may be inserted and/or placed together and body 201 may be sized and shaped to permit multiple insertions, for example, in a 4" hole commonly found in nuclear reactors. Body 201 may further include one or more connectors 202 that may permit holder 200 to be attached to extensions or insertion devices, such as a snaking cable.

Figure 5:
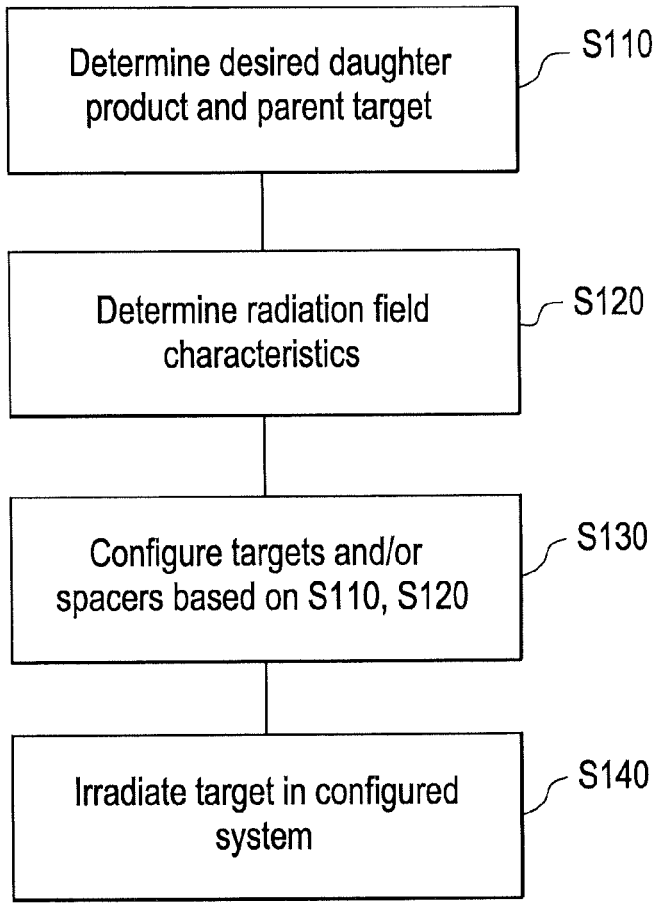
FIG. 5 is a flow chart illustrating example methods of using target plates and target holders.

Body 201 holds at least one example embodiment target plate 100. For example body 201 may include a shaft upon which target plates 100 may fit and be retained. Body 201 and parts thereof may be sized and shaped to match any of the various possible shapes of target plate 100, including a square, circular, triangular, etc. cross-section. As shown in FIG. 5, one or more spacer plates 203 may be placed with target plates 100 in or adjacent to body 201. Spacer plates 203 may separate and position target plates 100 at precise locations within example embodiment target plate holder 200 in order to achieve accurate exposure for irradiation targets 150 therein. Spacer plates 203 may have thicknesses that result in a desired degree of separation among target plates 100. For example, if example embodiment target plates 100 are fabricated and configured to substantially absorb neutron flux passing therethrough, a thicker spacer plate 203 may separate target plates 100 in target plate holder 200 to ensure that plates have a minimal effect on each other's irradiation, so as to achieve more even irradiation of irradiation targets 150 therein. Alternatively, more spacer plates 203 may be placed at greater frequency to achieve the same spacing and/or exposure as thicker spacer plates 203. Spacer plates 203 may be shaped and sized in any manner to achieve desired positions of target plates. Spacer plates 203 may be any shape, such as rectangular, triangular, annular, etc., based on positioning of target plates 100 in example embodiment target plate holder 200.

Spacer plates 203 may further provide for securing irradiation targets 150 within example embodiment target plates 100 stacked consecutively with spacer plates 203 on body 201. Spacer plates 203 may also be colored, textured, and/or bear other indicia that indicates their physical properties and/or the identities of irradiation targets 150 within target plates 100 placed adjacently.

Spacer plates 203 and body 201 may be fabricated of a material having a desirable radiation absorption profile. For example, spacer plates 203 and body 201 may have a low cross-section (e.g., approximately 5 barns or less) for thermal energy neutrons by being fabricated of a material such as aluminum, stainless steel, a titanium alloy, etc. Similarly, some spacer plates 203 and/or body 201 may be fabricated of materials having higher cross-sections for particular radiation fields, such as silver, gold, a boron-doped material, a barium alloy, etc. in thermal neutron fluxes. Spacer plates 203 may be strategically placed on body 201 based on its effect on the radiation field. For example, high cross-section (e.g., over 5 barns) spacer plates 203 placed on either side of target plates 100 may reduce or eliminate irradiation of irradiation targets 150 therein from the side, permitting a desired activity level of isotopes produced therefrom. Similarly, annular spacer plates 203 may provide for maximum irradiation of target plates 100 from a side.

The above-described features of example embodiment target plate holder 200 and spacer plates 203 and target plates 100 therein, and the known radiation profile to which target plate holder 200 is to be exposed may uniquely enable accurate irradiation of irradiation targets 150 used therein. For example, knowing an irradiation flux type and profile; a shape, size, and absorption cross-section of irradiation targets 150; precise positioning of irradiation targets 150 within radiation flux; size, shape, position, and absorption cross-section of example embodiment target plate 100 and spacing elements 105 therein; position of target plate 100 and spacer plate 203 within target plate holder 200; size, shape, and absorption cross-section of plate holder 200 and spacer plate 203, one may very accurately irradiate targets 150 to produce desired isotopes and/or radioisotopes. Similarly, one skilled in the art can vary any of these parameters in example embodiments in order to produce desired isotopes and/or radioisotopes.

FIG. 5 is a flow chart of an example method of using example embodiment target plates 100 and/or target plate holders 200. As shown in FIG. 5, the user determines a desired isotope/radioisotope to be produced, and amount to be produced, in example methods in S110. The desired isotope and amount thereof may be chosen based on any number of factors, including, for example, an available irradiation target, desired industrial application, and or an available radiation field. By virtue of correspondence between daughter product and parent nuclide, the user will also select the material and amount for irradiation targets 150 in S110.

In S120, the user will determine the characteristics of an available radiation field. The relevant characteristics may include type of radiation, energy of radiation, and/or variations of type and energy in a particular space. For example, the user may determine the level and variation of a neutron flux at a particular access point to a research reactor in S120. Alternatively, the user may determine the energy and type of ions encountered at a target stand in a particle accelerator in S120.

Based on the physical properties of the selected irradiation target 150 and the properties of the radiation field, both determined above, the user then configures target plate(s) 100, irradiation target(s) 150, target spacing element(s) 105, target plate holder(s) 200, and/or spacing plate(s) 203 in order to achieve an amount of irradiation necessary to produce a desired amount and/or activity of produced isotopes, in S130. Such configuration may include determining locations of loading positions 101 in target plate 100, placing and positioning irradiation targets 150 in target plates 100 at loading positions 101 with target spacing elements 105, and positioning target plates 100 in target plate holder 200 with spacing plates 203 to achieve a precise position of each irradiation target 150 within a radiation field. Additionally, such configuration may include selecting materials with known absorption cross-sections for a radiation spectrum relevant to the radiation field in order to achieve desired amounts of irradiation for irradiation targets 150 placed within that field. For example, a desired activity may be a substantially equal activity among several produced isotopes from several irradiation targets 150. In S130, the user may also calculate an exposure time based on the configuration, radiation field properties, and irradiation target 150 properties to achieve a desired magnitude of irradiation for irradiation targets 150 placed in example embodiment devices in that field.

In S140, the user may then place the configured irradiation targets 150 in example embodiment devices configured in S130 and place them into the determined radiation field so as to produce the desired isotopes and/or radioisotopes of a desired amount and/or activity. Alternatively, the user may deliver or otherwise provide the configured example embodiment devices for another to insert the irradiation targets 150 and irradiate them in the determined radiation field in S140.

Example embodiments and methods thus being described, it will be appreciated by one skilled in the art that example embodiments may be varied through routine experimentation and without further inventive activity. For example, although various example embodiment plates, holders, and spacers are used together with example methods of producing desired isotopes, each example embodiment may be used separately. Similarly, for example, although cylindrical example embodiments are shown, other device types, shapes, and configurations may be used in example embodiments and methods. Variations are not to be regarded as departure from the spirit and scope of the exemplary embodiments, and all such modifications as would be obvious to one skilled in the art are intended to be included within the scope of the following claims.

What is claimed is:

1. A method of providing an irradiation target positioning system, the method comprising:

determining an irradiation target and a daughter product produced from the irradiation target;

determining physical characteristics of a radiation field to which the irradiation target will be exposed;

configuring the irradiation target, an irradiation target plate, and a target plate holder to produce the daughter product when the irradiation target is loaded in the irradiation target plate and the target plate holder in the radiation field; and determining a quantity and a location of the irradiation target relative to a center of the irradiation target plate such that the quantity and the location of the irradiation target varies based on the physical characteristics of the radiation field.

2. The method of claim 1, further comprising:

loading the irradiation target into the irradiation target plate and the target plate holder; and irradiating the irradiation target loaded in the irradiation target plate and the target plate holder in the radiation field so as to produce the daughter product.

3. The method of claim 2, wherein the radiation field is a neutron flux including thermal neutrons produced in a light-water reactor.

4. The method of claim 2, wherein the configuring includes providing at least one of, a shape, size, and known absorption cross-section for the irradiation target, a constant position of the irradiation target in the radiation field to be maintained by the irradiation target plate and the target plate holder, and materials for the irradiation target plate and the plate holder with known absorption cross-sections for the radiation field.

5. The method of claim 1, wherein the physical characteristics of the radiation field include at least one of radiation type and radiation energy distribution over position.

6. The method of claim 1, wherein the irradiation target is fabricated from a material including at least one of cobalt (Co), chromium (Cr), copper (Cu), erbium (Er), germanium (Ge), gold (Au), holmium (Ho), iridium (Ir), lutetium (Lu), molybdenum (Mo), palladium (Pd), samarium (Sm), thulium (Tm), ytterbium (Yb), and yttrium (Y).

7. The method of claim 1, wherein the configuring includes providing at least one loading position in the target plate for the irradiation target.

8. The method of claim 7, wherein the configuring further includes defining a hole in the target plate at each loading position, the hole configured to retain the irradiation target in the target plate.

9. The method of claim 8, wherein the configuring further includes placing at least one target spacing element in the hole so as to maintain the irradiation target at a constant position within the loading position.

10. The method of claim 8, wherein the configuring further includes placing at least one spacer plate in the target plate holder so as to maintain the target plate and at least one loading position at the constant position within the radiation field.

11. The method of claim 10, wherein the at least one spacer plate is placed adjacent to the target plate in the target plate holder so as to retain the irradiation target at the constant position.

12. The method of claim 1, wherein the configuring includes providing the irradiation target plate with a first planar surface and an opposing second planar surface, a distance between the first and second planar surfaces being less than a diameter or length of the irradiation target plate.

13. The method of claim 1, wherein the configuring includes providing the irradiation target plate with an opening extending through the center and a plurality of holes surrounding the opening, the opening being larger than each of the plurality of holes.

14. The method of claim 13, wherein the configuring includes inserting the target plate holder through the opening of the irradiation target plate.

* * * * *